US011613879B2

(12) United States Patent
Ta

(10) Patent No.: US 11,613,879 B2
(45) **Date of Patent: *Mar. 28, 2023**

(54) CONNECTOR FOR GUIDING LIQUID OVERFLOW OUT OF A DISPOSABLE LINER WHEN RECEIVED IN A BASIN FOR CONTACTING THE LIQUID AND RELATED METHOD

(71) Applicant: Contego Spa Designs Inc., Garden Grove, CA (US)

(72) Inventor: Jeff Ta, Garden Grove, CA (US)

(73) Assignee: Contega Spa Designs, Inc., Garden Grove, CA (US)

( * ) Notice: Subject to any disclaimer, the term of this patent is extended or adjusted under 35 U.S.C. 154(b) by 393 days.

This patent is subject to a terminal disclaimer.

(21) Appl. No.: 16/709,655

(22) Filed: Dec. 10, 2019

(65) Prior Publication Data

US 2020/0141100 A1 May 7, 2020

Related U.S. Application Data

(63) Continuation-in-part of application No. 15/907,520, filed on Feb. 28, 2018, now Pat. No. 10,513,840.

(30) Foreign Application Priority Data

Feb. 26, 2019 (CA) ..... CA 3034933

(51) Int. Cl.
*E03C 1/24* (2006.01)
*E03C 1/244* (2006.01)
*E03C 1/14* (2006.01)
*A47K 3/022* (2006.01)

(52) U.S. Cl.
CPC ..... *E03C 1/244* (2013.01); *E03C 1/14* (2013.01); *A47K 3/022* (2013.01)

(58) Field of Classification Search
CPC ..... E03C 1/24
USPC ..... 4/580, DIG. 18, 655
See application file for complete search history.

(56) References Cited

U.S. PATENT DOCUMENTS 5,661,857 A * 9/1997 McLean ..... E03C 1/18 4/657
7,437,779 B2 * 10/2008 Kenny ..... A47K 3/281 4/580
9,289,353 B2 3/2016 Ta

* cited by examiner

*Primary Examiner* — Lauren A Crane
(74) *Attorney, Agent, or Firm* — Ade & Company, Inc.

(57) ABSTRACT

A connector for use with a disposable flexible liner installed in a basin to contact liquid is provided to bridge between an overflow opening provided in the liner and an overflow aperture provided in an upright wall of the basin, so that when liquid containable in an interior volume of the basin exceeds a prescribed height, the liquid is enabled to drain out of the interior volume through the liner at the communicated openings/apertures. A conduit formed by the connector for insertion into the basin to bridge between the communicated openings/apertures is arranged for a friction fit in an overflow throat extending from the overflow aperture defined in the basin. A related method for using a replaceable liner in a basin having an overflow aperture is also disclosed.

38 Claims, 6 Drawing Sheets

CONNECTOR FOR GUIDING LIQUID OVERFLOW OUT OF A DISPOSABLE LINER WHEN RECEIVED IN A BASIN FOR CONTACTING THE LIQUID AND RELATED METHOD

This is a continuation-in-part application of U.S. parent application Ser. No. 15/907,520, filed Feb. 28, 2018. This application claims the benefit of Canadian patent application 3,034,933, filed Feb. 26, 2019.

FIELD OF THE INVENTION

The present invention relates to a connector for facilitating overflow drainage of a liquid contained in a basin through an aperture defined in an upstanding or upright wall of the basin, and more specifically to a connector of this type used in conjunction with an opening formed in a disposable flexible liner which is used as a replaceable receptacle to contact the liquid in the basin.

BACKGROUND

Using the pedicure spa industry as one example, hygiene is an important matter as it is easy to transfer infection and disease from one patient to another if those surfaces which make contact with a soaking solution receiving the patient's feet are not properly sanitized after each treatment.

For this reason, disposable liners were introduced to the industry which removed altogether the step of sanitization between treatments of different patients performed in a common basin. That is, an imperforate flexible disposable liner is placed to cover or line interior surfaces of the soaking basin of a foot spa apparatus, which otherwise would be in contact with the soaking solution. Thus, at the end of the treatment for a patient, the soaking solution can be drained and the used liner which may carry any skin cells, chemicals, and other potential contaminants is simply disposed of so that a new liner free of any potential contaminants can be installed in the same soaking basin for the following patient's treatment.

Typically, disposable liners of the type used in the pedicure spa industry are draped over a top rim of the soaking basin and depend downwardly therefrom to a bottom floor of the basin so that the floor and upstanding peripheral wall are fully covered by the liner. A surface of the soaking basin of the type receiving the liner is smooth and is uninterrupted other than by a drainage hole in the floor of the basin through which the soaking solution is discharged by gravity at the end of the treatment to empty the receptacle formed by the liner laid in the soaking basin, so that the used liner subsequently can be discarded. Drainage at the end of a treatment acts to puncture the initially imperforate liner at a location over the drainage hole so that the used soaking solution flows out by gravity. As the liner is now irreversibly perforated, particularly at a location registrable with the drainage hole, it is no longer suited for use to contain soaking solution, which is acceptable given that the used liner is to be discarded as waste.

Furthermore, in the pedicure spa industry it is desirable to purposefully cause the soaking solution to overflow for example when the soaking solution is not at a suitable temperature in which case water of the desired temperature is added while the soaking solution already contained within the basin of the less desirable temperature is displaced by overflowing out of the basin. One way in which overflow can be performed in a controlled manner is described in U.S.

Pat. No. 9,289,353 to Ta where a portion of the top rim is lowered as if to form a spout across which the overflowing solution can escape from the basin. This arrangement is still suited for use with the imperforate flexible disposable liner, which, as in the conventional sense, drapes over the top rim including where it is lowered to form the spout for guiding the overflow, in order to properly cover the soaking basin to protect it from any potential contaminants.

SUMMARY OF THE INVENTION

According to an aspect of the invention there is provided a connector for guiding liquid out of a disposable flexible liner received in a basin for contacting the liquid when the liquid has exceeded a prescribed height in the basin;

the basin having:

a bottom surface and an upright peripheral wall surface extending upwardly from the bottom surface to a top rim of the basin, the peripheral wall surface and the bottom surface collectively defining an interior volume of the basin within which the liquid can be contained;

an overflow aperture being defined in the peripheral wall surface of the basin at a location spaced above the bottom surface to enable the liquid to exit the interior volume of the basin when the liquid exceeds the prescribed height therein;

an overflow drainage conduit located externally of the interior volume of the basin for guiding the liquid which has exited the interior volume of the basin away therefrom;

a throat fluidically communicating the overflow aperture and the overflow drainage conduit;

the liner having:

a body of flexible impermeable material forming an amorphous bag, which has a peripheral edge defining an open top of the bag, for placing in the basin in a working position of the liner in which the body of flexible impermeable material is covering the peripheral wall surface and the bottom surface of the basin for containing the liquid;

the bag having a first inner side delimiting an interior of the bag for retaining the liquid and a second outer side being adapted for contacting the basin in the working position of the liner;

the bag having a thickness measured from the first inner side of the bag to the second outer side of the bag;

the connector comprising:

a conduit adapted to convey liquid and arranged for fluidically communicating the overflow aperture of the basin with an overflow opening formable through the thickness of the bag at a spaced location from the peripheral edge thereof, so that when the liquid retained by the liner in the working position exceeds the prescribed height, the liquid is enabled to drain out of the interior of the bag through the conduit and out of the interior volume of the basin.

In this arrangement the liquid is enabled to escape the interior volume of the basin, by overflow, at an intermediate location on the liner through the liner in a thickness direction thereof, as provided by the overflow opening defined therein formed through a thickness of the liner and the connector bridging from the overflow opening to the overflow aperture accordingly provided in the basin.

In one arrangement, the conduit comprises first and second ends between which a path for overflow through the conduct is defined, and a transverse periphery of the conduit, which is transverse relative to the path for overflow, is sized and shaped in a manner arranged to substantially match a void defined by the throat so that in the operating position the conduit is supported in the throat by nesting therein with an outer surface of the conduit in contact with an interior peripheral surface of the throat.

In one arrangement, the connector further includes a circumferential lip extending transversely from an outer surface of the conduit with respect to a path for overflow defined between opposite ends of the conduit, the lip defining an annular contact surface which meets the outer surface of the conduit around a circumference thereof and which is arranged to contact the first inner side of the bag around the overflow opening such that a fluidic seal can be formed therewith.

In one arrangement, wherein the bag meets an outer surface of the conduit such that the overflow opening is sized and shaped to match the conduit's transverse periphery defined by the outer surface of the conduit.

In one arrangement, the connector is fastened to the liner so that the liner and the connector are unitary, the connector thus being suited for disposal with the liner after use when the liquid has been drained from the liner.

According to another aspect of the invention there is provided a connector for bridging between an overflow aperture in a basin and an overflow opening in a disposable flexible liner which can be disposed in a working position in the basin to contain a liquid;

the basin having a bottom surface and an upright peripheral wall surface extending upwardly from the bottom surface to a top rim of the basin, the peripheral wall and the bottom surface collectively defining an interior volume of the basin within which the liquid can be contained;

in the working position, the liner covering the bottom surface and the peripheral wall surface of the basin so that the liner forms a receptacle for retaining the liquid;

the receptacle formed by the liner having a floor portion and a peripheral wall portion extending upwardly therefrom which in the working position are registered with the bottom surface of the basin and the peripheral wall surface of the basin respectively;

the overflow aperture of the basin being defined in the peripheral wall surface of the basin at a location spaced above the bottom surface to enable the liquid to exit the interior volume of the basin when the liquid exceeds a prescribed height therein;

an overflow drainage conduit located externally of the interior volume of the basin for guiding the liquid which has exited the interior volume of the basin away therefrom;

a throat fluidically communicating the overflow aperture and the overflow drainage conduit;

the throat having an interior surface which encompasses a direction of overflow through the throat from the overflow aperture to the overflow drainage conduit;

the overflow opening of the liner being formed through a thickness of the liner from a first inner side of the liner delimiting an interior of the liner for retaining the liquid and a second outer side adapted for contacting the basin in the working position of the liner;

the overflow opening of the liner being defined in the peripheral wall portion so as to register with the overflow aperture of the basin in the working position of the liner so that when the liquid retained by the liner within the basin exceeds the prescribed height, the liquid is enabled to drain out of the liner via the overflow opening of the liner and out of the interior volume of the basin via the overflow aperture which is communicated with the overflow opening of the liner;

the connector comprising:

a conduit adapted to convey the liquid from a first end to a second insertion end between which is defined a path for overflow through the conduit;

the conduit having an interior surface which is exposable to the liquid and an opposite outer surface;

the conduit being arranged to form a fluidic seal with the liner at the overflow opening therein;

the connector being arranged for bridging between the overflow opening and the overflow aperture in the basin and extending past the overflow aperture into the throat of the basin in an operating position of the connector in which the first end of the conduit is in fluidic communication with the interior of the liner and the second insertion end of the conduit is located in or adjacent the throat, so that when the liquid retained by the liner within the basin exceeds the prescribed height the liquid is enabled to drain out of the interior volume of the basin without leaking between the second outer side of the liner and the peripheral wall surface of the basin; and the outer surface of the conduit defining a transverse periphery of the conduit, which is transverse relative to the path for overflow through the conduit, that is sized and shaped to substantially match a void defined by the interior surface of the throat so that in the operating position the outer surface of the conduit is in contact with the interior surface of the throat in a manner so as to support the conduit in the throat.

In one arrangement the connector is fastened to the liner so that the liner and the connector are unitary, the connector thus being suited for disposal with the liner after use when the soaking solution has been drained from the liner.

In one arrangement the connector comprises a circumferential lip extending transversely from the outer surface of the conduit with respect to the path for overflow defined by the conduit, the lip defining an annular contact surface which meets the outer surface of the conduit around a circumference thereof and which, in the operating position, is arranged to be in contact with the first inner side of the liner around the overflow opening, such that in the operating position the lip is spaced from the peripheral wall surface of the basin by the thickness of the liner.

In one arrangement the liner meets the outer surface of the conduit of the connector such that the overflow opening in the liner is sized and shaped to match the transverse periphery of the conduit. This feature, when combined with the circumferential lip, provides a sturdy mounting or fastening location for the connector to the liner.

Preferably the connector is formed from a material which is substantially stiff in comparison to the liner which is flexible so that the connector disposed in the operating position acts to locate the overflow opening in substantial axial alignment with the overflow aperture in the soaking basin so as not to be inadvertently displaced during addition of soaking solution into the receptacle formed by the liner which is not directly fastened to interior surfaces of the soaking basin.

According to yet another aspect of the invention there is provided a disposable liner for use with a basin to contain a liquid;

the basin comprising:

a bottom surface and an upright peripheral wall surface extending upwardly from the bottom surface to a top rim of the basin, the peripheral wall surface and the bottom surface collectively defining an interior volume of the basin within which the liquid can be contained;

an overflow aperture being defined in the peripheral wall surface of the basin at a location spaced above the bottom surface to enable the liquid to exit the interior volume of the basin when the liquid exceeds a prescribed height therein;

an overflow drainage conduit located externally of the interior volume of the basin for guiding the liquid which has exited the interior volume of the basin away therefrom;

a throat fluidically communicating the overflow aperture and the overflow drainage conduit;

the disposable liner comprising:

a body of flexible material forming an amorphous bag, which has a peripheral edge defining an open top of the bag, for placing in the basin in a working position of the liner in which the body of flexible material is covering the peripheral wall surface and the bottom surface of the basin for containing the liquid;

the bag having a first inner side delimiting an interior of the bag for retaining the liquid and a second outer side being adapted for contacting the basin in the working position of the liner;

the bag having a thickness measured from the first inner side of the bag to the second outer side of the bag;

the bag having a central portion substantially opposite from the open top and arranged to register with the bottom surface of the basin in the working position;

the bag having a fringe portion surrounding the central portion and terminating at the peripheral edge that is arranged to register with the peripheral wall surface of the basin in the working position;

the bag defining an overflow opening located in the fringe portion at a spaced location from the peripheral edge and formed through the thickness of the bag for positioning in communication with the overflow aperture in the basin such that the interior of the bag is communicated with an outside thereof through the overflow opening at the spaced location from the open top of the bag so that when the liquid retained by the liner in the working position exceeds the prescribed height, the liquid is enabled to drain out of the interior of the bag via the overflow opening of the liner which is communicated with the overflow aperture of the basin so that the liquid is further enabled to drain out of the interior volume of the basin;

a conduit mounted in fluidic communication with the overflow opening of the bag;

the conduit forming a fluidic seal with the bag at the overflow opening;

the conduit adapted to convey the liquid from an inner end of the conduit to an outer insertion end of the conduit between which is defined a path for overflow through the conduit;

the inner end of the conduit being located at the overflow opening;

the outer insertion end of the conduit being located outside the interior of the bag; and the outer insertion end of the conduit being spaced from the second outer side of the bag so that the conduit protrudes therefrom for passing through the overflow aperture and into the throat in an operating position of the conduit so that the liquid is enabled to pass from the interior of the bag through the conduit and into the overflow drainage conduit.

Preferably, a transverse periphery of the conduit is sized and shaped in a manner arranged to substantially match a void defined by the throat so that in the operating position the conduit is supported in the throat by nesting therein with an outer surface of the conduit in contact with an interior peripheral surface of the throat.

In one arrangement there is provided a circumferential lip extending transversely from an outer surface of the conduit with respect to the path for overflow defined by the conduit, the lip defining an annular contact surface which meets the outer surface of the conduit around a circumference thereof and which is in contact with the first inner side of the bag around the overflow opening so that the inner end and the outer insertion end of the conduit are located on opposite sides of the bag.

In one arrangement the bag meets the outer surface of the conduit such that the overflow opening is sized and shaped to match the conduit's transverse periphery defined by the outer surface of the conduit.

According to yet another aspect of the invention there is provided a method of using a replaceable liner to contain liquid in a basin, the basin having an overflow aperture defined in an interior surface of the basin at a spaced height above a bottom of the basin to enable the liquid to drain out of an interior of the basin which is delimited by said interior surface when the liquid exceeds a prescribed height therein, the method comprising:

applying the replaceable liner in the form of a thin flexible material over the interior surface of the basin to contain the liquid within the liner and to cover the overflow aperture;

puncturing the liner so as to form an opening therein at a location registering with the overflow aperture in the basin; and inserting a conduit between the opening formed in the liner and the overflow aperture so that the liquid contained by the liner is enabled to drain out of the liner through the conduit and subsequently out of the interior of the basin.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

Figure 7:
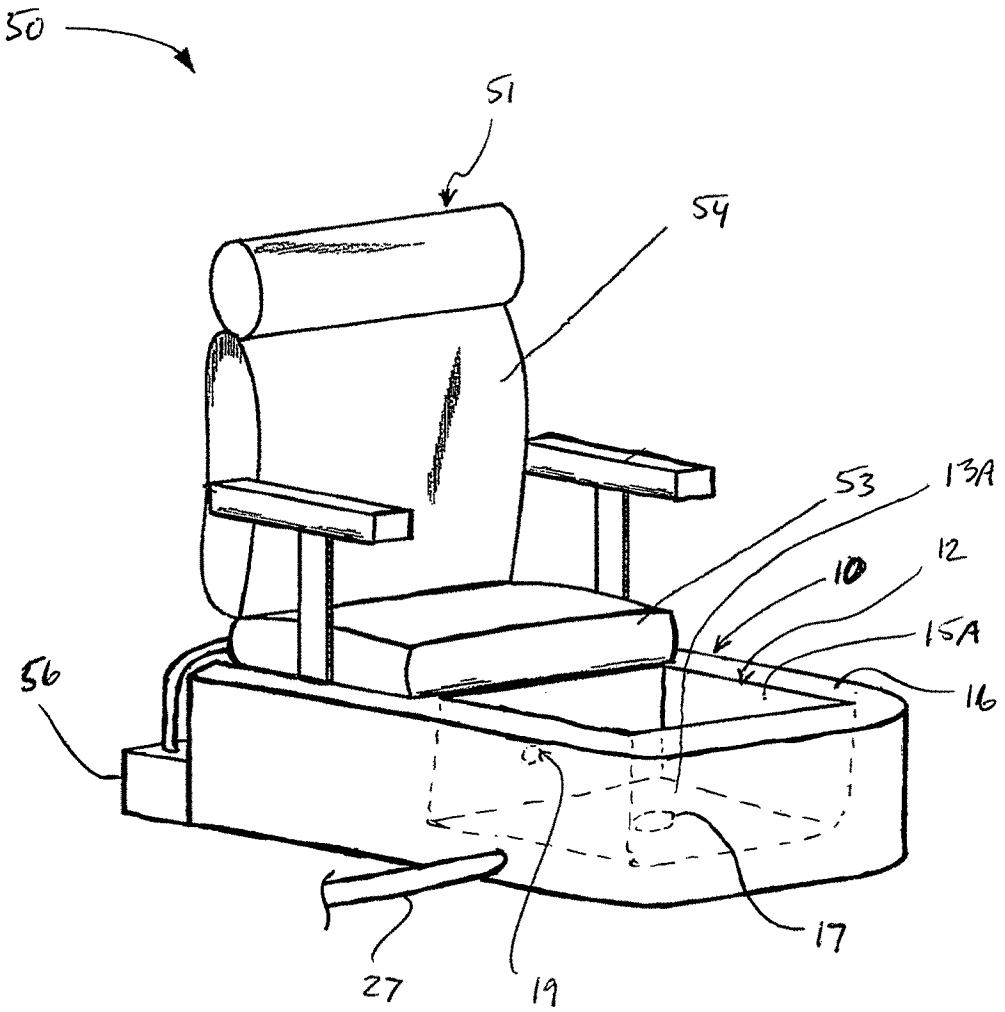
FIG. 7 is a perspective view of an arrangement of foot spa apparatus incorporating the soaking basin, disposable liner, and connector according to the present invention.

The accompanying figures show a disposable liner 1 and a corresponding overflow connector 100 for use in a soaking basin 10 of a foot spa apparatus 50 used in a pedicure spa industry to treat feet of a patient. The foot spa apparatus 50 as shown in FIG. 7 typically also includes a chair 51 for receiving the patient mounted on a common base adapted for resting on a floor. The common base also carries the soaking basin 1 which is shown as integrally formed with the common base. The soaking basin is located forwardly of and below a seat portion 53 of the chair opposite to a backrest portion 54 of the chair. The foot spa apparatus 50 typically also includes an air supply apparatus 56 for supplying air into the soaking solution contained within the basin to provide massaging of the feet of the patient which are received in the soaking solution.

Figure 1:
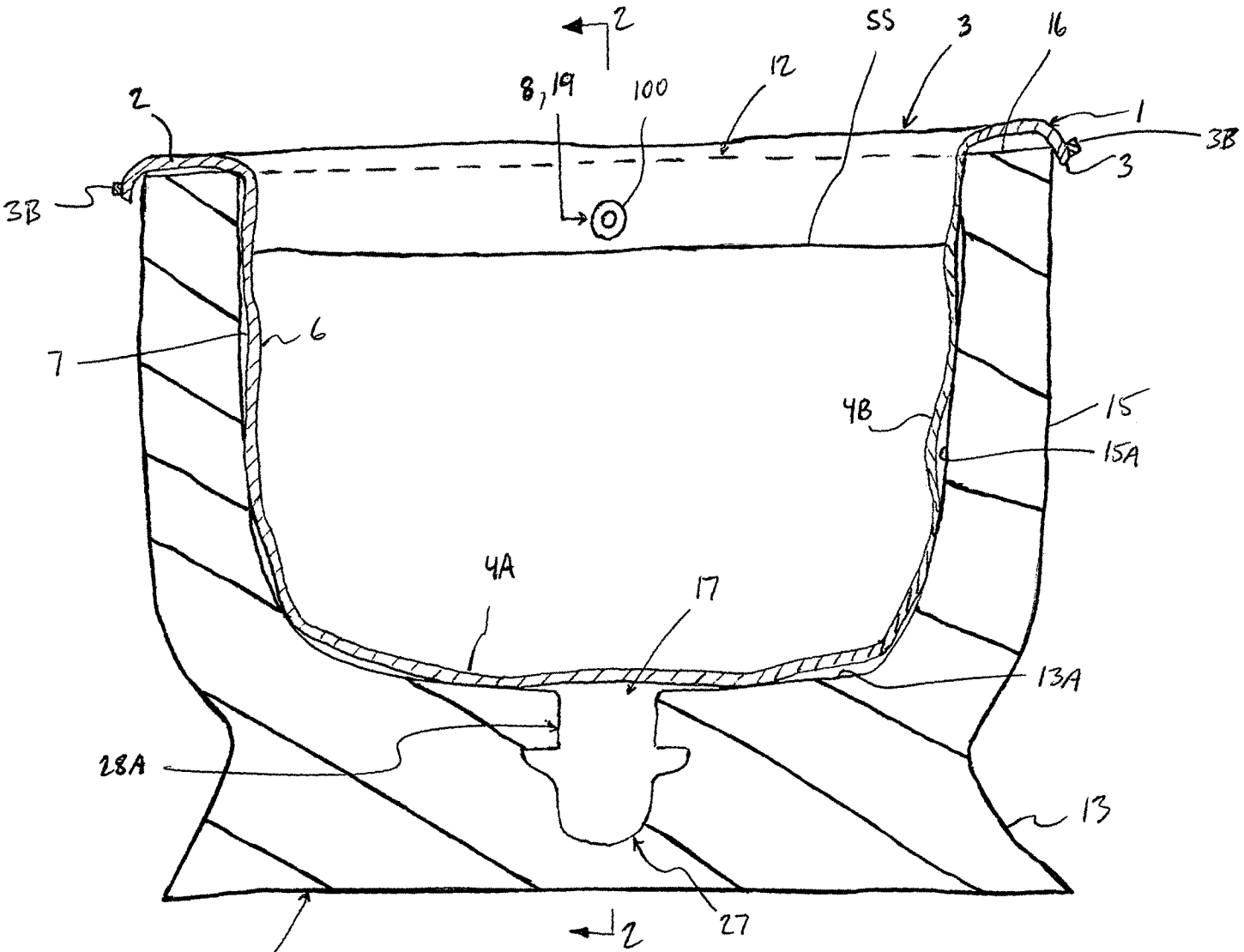
FIG. 1 is a cross-sectional view of a soaking basin of a foot spa apparatus with a disposable flexible liner placed therein, according to an arrangement of the present invention.
Figure 2:
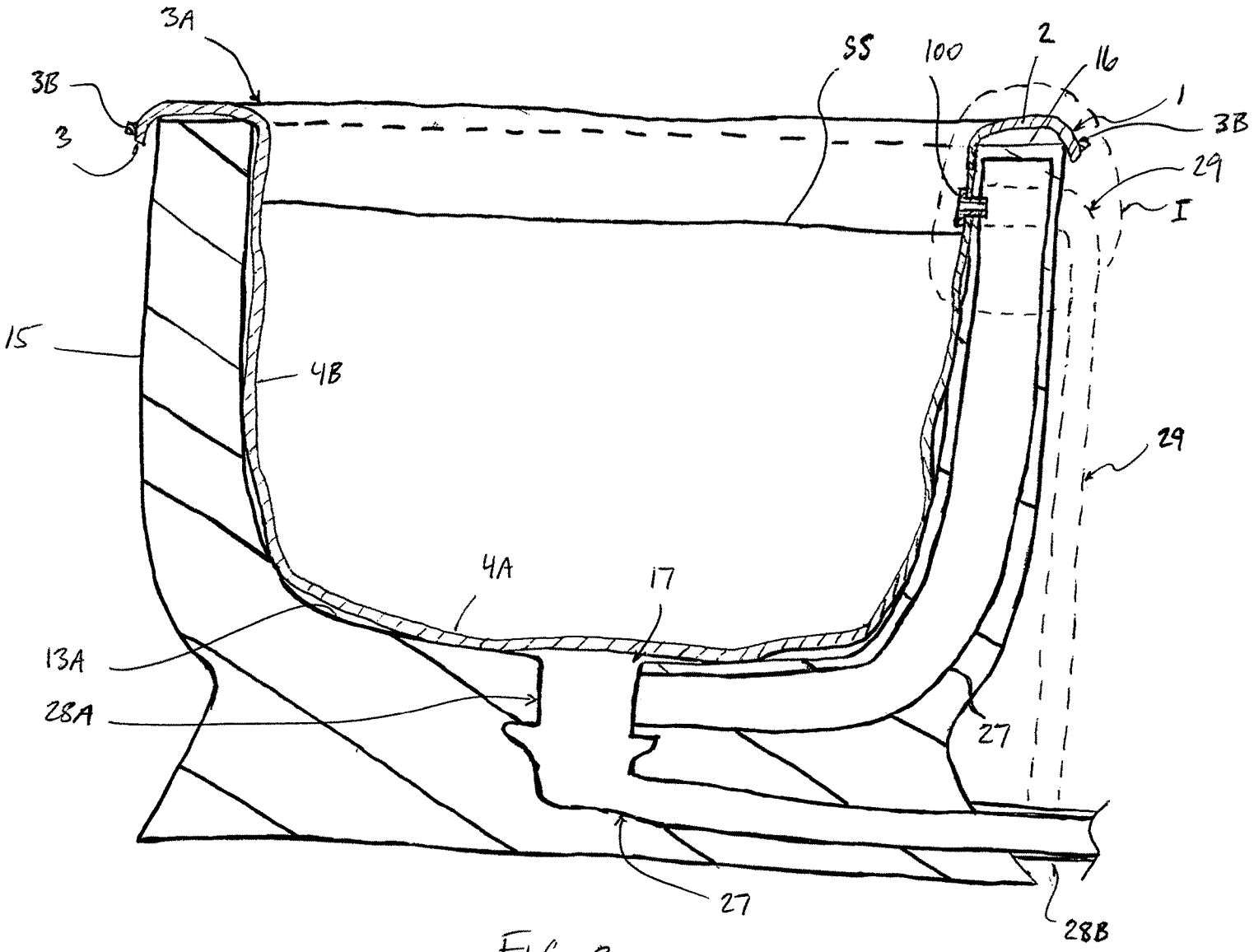
FIG. 2 is a cross-sectional view along line 2-2 in FIG. 1.

Referring to FIGS. 1 and 2, the soaking basin 10 forms a bowl with an open top 12, a base 13 defining a bottom floor surface 13A which defines a horizontal plane containing a horizontal periphery of the floor surface, and an upstanding peripheral wall 15 extending upwardly from the base so as to define a top rim 16 of the basin delimiting the open top 12. The peripheral wall 15 defines an upright peripheral wall surface 15A extending upwardly from the bottom surface 13A defined by the base, which surfaces collectively define an interior volume of the soaking basin within which the soaking solution can be contained.

The soaking basin 10 includes a drainage hole 17 defined in the bottom floor surface 13A through which the soaking solution is discharged from the interior volume of the basin by gravity, typically at the end of a treatment, so as to empty same.

In the illustrated arrangement, the soaking basin includes an overflow aperture 19 which is defined in the peripheral wall surface 15A so as to open in a horizontal direction. The overflow aperture 19 is disposed at a spaced location at a prescribed height for overflow above the bottom floor surface 13A, located much closer to the top rim 16 of the basin than to the floor surface 13A so that a prescribed amount of soaking solution, as indicated at SS, can be contained within the soaking basin without necessarily escaping therefrom through the overflow aperture 19. Thus a bottom of the overflow aperture, that is its lowest point, is located at or spaced above a prescribed height of soaking solution which corresponds to the prescribed maximum amount of solution SS containable in the basin. The overflow aperture 19 provides a controlled exit for flow of the soaking solution at a location below the top rim of the basin, when a height of the solution exceeds the prescribed amount SS. The overflow aperture 19 is fluidically communicated via an adjacent throat 22 with an overflow drainage conduit 24 extending downstream from the throat 22 and located externally of or outside the interior volume of the basin along with the throat for guiding the liquid solution away from the interior volume to another location. In other words, the throat 24 fluidically connects the overflow aperture 19 and the overflow drainage conduit. Typically the overflow drainage conduit 24 is fluidically communicated with a waste drainage conduit 27 which is fluidically communicated with the drainage hole 17 and carries the used waste soaking solution away from the interior volume of the basin to a downstream sewage collection system to which the waste conduit 27 is operatively fluidically coupled.

The throat 22 forming an intermediary communicative passageway between the overflow aperture 19 and the overflow drainage conduit 24 is formed integrally with the soaking basin through a thickness of a wall of the soaking basin from the peripheral wall surface 15A to an opposite face of the wall across its thickness so as to bridge a distance between the peripheral wall surface 15A carrying the overflow aperture 19 and the overflow drainage conduit 24 presented at this opposite wall face of the basin in communication with the throat. The throat therefore defines a three-dimensional void in the peripheral wall 15 of the soaking basin communicating the interior volume of the basin with the overflow drainage conduit 24. This void defined by the throat is delimited circumferentially by an interior peripheral surface 25 of the throat and at one terminal end by the overflow aperture and at the opposite terminal end by an opening 26 communicating the throat and overflow drainage conduit 24. In the illustrated arrangement the void is circular cylindrical in shape so as to have uniform cross-section from the overflow aperture 19 to the interior opening 26. Further, the interior peripheral surface 25 of the throat follows a circular path along the circumference of the throat so as to lack any protrusions or recesses relative to the terminating openings of the throat.

Referring to FIG. 2, in one example of soaking basin having overflow drainage means, the overflow drainage conduit 24 is formed by a cavity 27 defined integrally within the upright peripheral wall 15 which is communicated with the overflow aperture via the throat 22 and extends vertically downwardly therefrom along the wall and subsequently extends horizontally into the base 13 of the basin so as eventually to be communicated with a vertically downwardly extending initial portion 28A of the waste drainage conduit which is adjacent to and trails downstream from the drainage hole 17. Thus the throat 22 is formed through a thickness of an inner wall portion of the basin wall 15. In another example thereof, the overflow drainage conduit is formed by a distinct pipe 29, shown in phantom in FIG. 2, communicatively coupled with the throat at a surface of the basin wall in which the interior throat opening 26 is defined, which pipe extends from the throat and fluidically communicates with the waste drainage conduit 27 farther downstream in comparison to the previous example, at a substantially horizontally extending downstream portion 28B of the waste drainage conduit. Typically in this type of arrangement the throat is formed through a full thickness of the peripheral basin wall 15 which would be approximately as thick as the inner wall portion more clearly illustrated in FIGS. 3A and 3B.

Referring back to FIG. 1, and turning now to the disposable liner 1, the liner comprises a flexible body of plastic material 2 which forms an amorphous bag with a peripheral edge 3 defining an open top 3A, such that the bag is open. Generally speaking, the liner is of a simple film of suitable impermeable material, typically plastics. The liner 1 is configured to be disposed in the basin in a working position of the liner by draping the bag over the top rim 16 and arranging a remainder of the plastic body to cover interior surfaces of the basin, that is the bottom floor surface 13A and the upright peripheral wall surface 15A. The liner 1 may be secured in fixed location to the basin over the rim 16, for example by an elastic band 3B in the form of an endless loop attached to the bag at or adjacent the peripheral edge 3 so as to encompass same, such that the elastic band tends to decrease a size of the opening at the top 3A. Generally speaking, the body of plastic has a central portion 4A forming a bottom of the bag and a fringe portion 4B which encompasses the central portion 4A and terminates at the peripheral edge 3. In the working position the liner forms a receptacle having a floor portion defined by the central portion 4A which registers with the bottom floor surface 13A and is positioned over the drainage hole 17 so as to cover same, and having a peripheral wall portion extending upwardly from the floor portion, defined by the fringe portion 4B which registers with the peripheral wall surface 15A. Thus, first and second sides of the body of plastic define inner and outer sides 6 and 7 of the receptacle, where the inner side 6 faces inwardly towards the interior volume (which is negligibly affected in size once the liner is inserted into the basin to cover the interior surfaces) and the outer side 7 of the plastic liner is presented in a manner to contact the interior surfaces of the basin. Thus the first inner side 6 delimits an interior of the bag for retaining the soaking solution, and the second outer side 7 is adapted for contacting the soaking basin in the working position of the liner. It will be appreciated that the liner conforms to the shape of the basin especially once the soaking solution is received therein, with the outer side 7 of the liner pressed against the interior surfaces of the basin such that any air gaps therebetween which may be present when the receptacle is empty are no longer present.

The body of plastic defines an overflow opening 8 in the fringe portion 4B at a spaced location from the peripheral edge 3, so that the overflow opening is disposed at a location on the fringe portion which is registered with the peripheral wall surface 15A of the basin because a peripheral portion of the fringe portion of the liner including the terminating edge 3 covers the top rim 16 in the working position, with the edge 3 located on an outside of the basin wall. Aside from the overflow opening 8 the liner is imperforate.

Figure 3A:
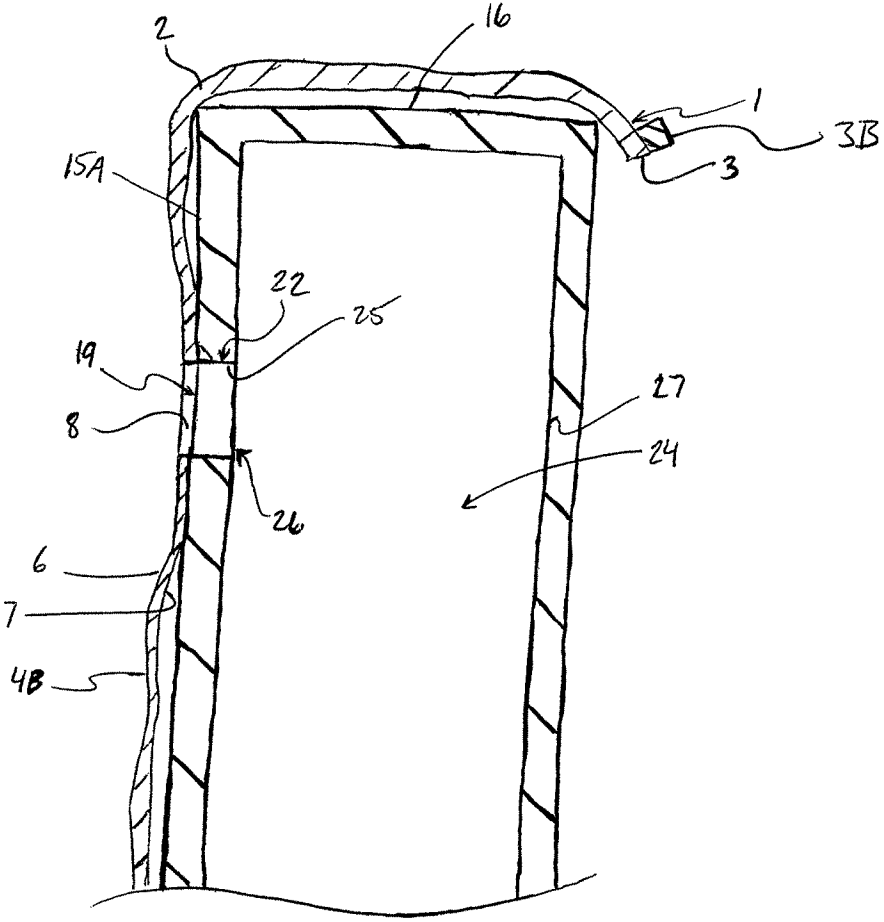
FIG. 3A is an enlarged partial view of the area indicated at I in FIG. 2 with a connector of the arrangement as shown in FIG. 1 removed for clarity of illustration of other components.

Referring to FIG. 3A, the overflow opening 8 is formed through a thickness of the plastic body from the first inner side 6 to the second outer side 7 so that the interior of the bag formed by the plastic body of the liner is communicated with an outside of the bag across the thickness of the liner or in a thickness direction through the overflow opening. Thus, liquid solution contained in the receptacle formed by the liner, and thus in contact with the first inner side 6 which becomes the dirtied or soiled, and thus contaminated, side of the liner when used, can flow from the interior of the bag or liner and out in the thickness direction through the liner via the overflow opening 8. In the working position of the liner the overflow opening 8 is registered with the overflow aperture 19 in the basin wall so that these two openings/apertures are communicated, and thus if the solution reaches a level where it will tend to flow out of the overflow opening 8, then it will flow through this opening 8 and subsequently can flow through the basin overflow aperture 19 so as to eventually escape from the interior volume of the basin to another location, such as the waste drain.

As such, the connector 100 is provided to facilitate flow of overflow solution from the interior volume to the overflow drainage conduit 24 without overflow solution leaking in between the liner 1 and the basin wall interior surface 15A so as to avoid contamination of the basin.

Referring to FIG. 3B and FIGS. 4-6, the connector 100 comprises a tubular conduit 102 extending from an inner end 104 to an outer insertion end 105 to define a path for overflow through the conduit. A transverse periphery 107 of the conduit, relative to the path for overflow therethrough, is sized and shaped to substantially match the void defined by the throat 22 so that the conduit 102 is arranged for nesting in the throat so as to be retained therein by a friction fit, that is by frictional engagement with the interior peripheral surface 25 of the throat. In the illustrated arrangement the throat 22 lacks any additional features such as ridges or ribs which protrude inwardly past the periphery of the overflow aperture 19, defining a mouth in relation to the throat 22, or grooves which are recessed outwardly therefrom which may modify either the size or shape of the throat receiving the conduit in nesting configuration, and therefore the transverse periphery 107 of the conduit is identical in shape to the void and is slightly downwardly graduated in cross-sectional size so as to be receivable in the throat 22 in friction fit. The transverse periphery 107 of the conduit is circular, and generally speaking, the conduit is circular cylindrical in shape as the throat maintains a uniform cross-section from the overflow aperture 19 to the interior throat aperture 26 at which the throat is communicated with the overflow drainage conduit 24.

The connector 100 of the illustrated arrangement also includes a circumferential lip 110 extending transversely outwardly from an outer surface 112 of the conduit defining the conduit transverse periphery 107, with respect to the path for overflow defined by the conduit. In the illustrated arrangement this lip 110 projects radially from the outer conduit surface 112 to a peripheral rim 113 of the lip and defines on one side of the lip an annular contact surface 114 which meets the outer surface 112 at right angles around the circumference of the conduit 102. On an opposite side of the lip 110 is a solution-side surface which is flush with an annular face portion of the conduit inner end 104. An interior passageway 116 defined by the connector along its full length is circular cylindrical in shape so as to be uniform in shape and size along the full length of the connector.

Figure 3B:
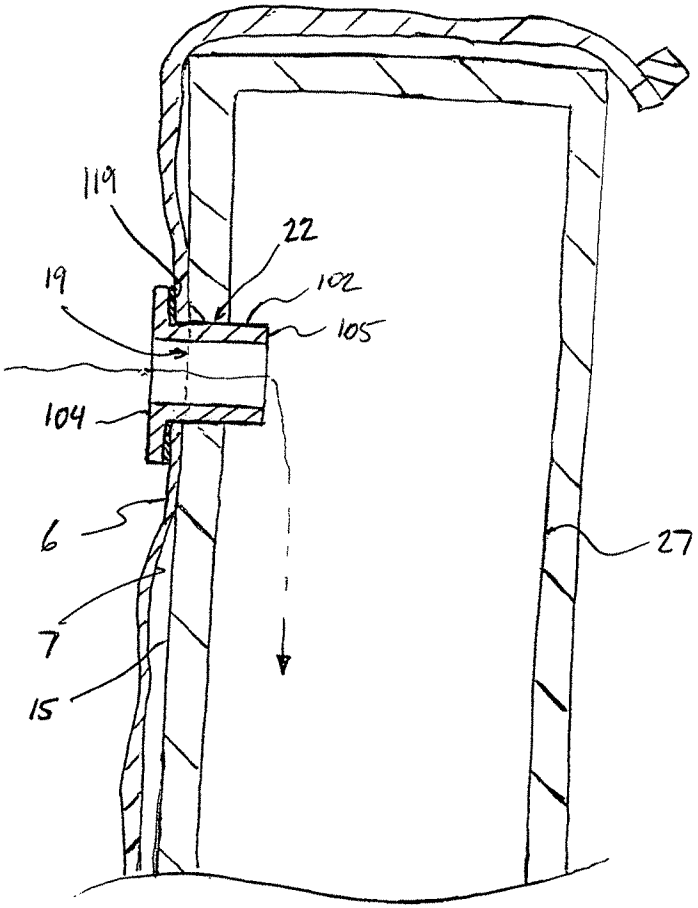
FIG. 3B is an enlarged partial view indicated at I in FIG. 2, and thus is similar to FIG. 3A but not omitting any components.
Figure 4:
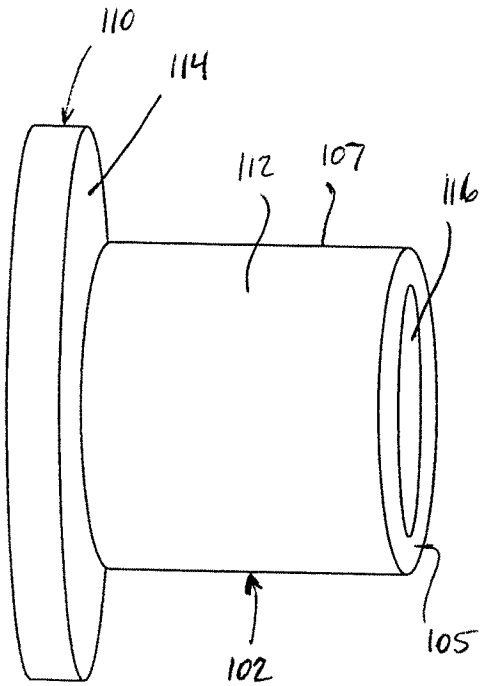
FIG. 4 is a perspective view of the connector of the arrangement as shown in FIG. 1, illustrated in isolation.
Figure 5:
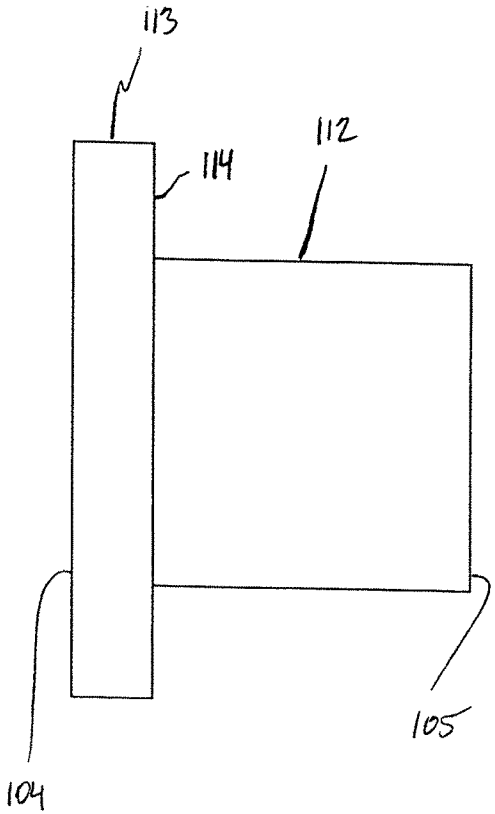
FIG. 5 is a side elevational view of the connector as shown in FIG. 4.
Figure 6:
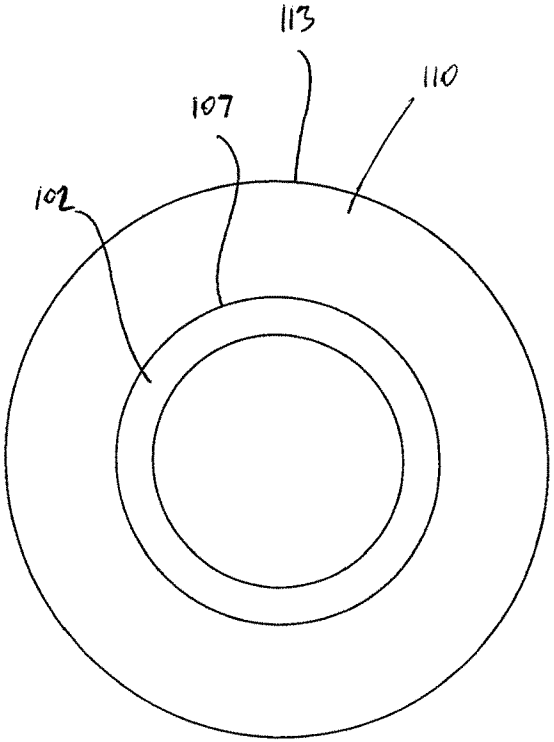
FIG. 6 is an end view from an insertion end of the connector as shown in FIG. 4.

As such, the connector 100 is usable to facilitate the flow of overflow solution out of the interior volume of the basin 10 through the communicated openings/apertures, one indicated at 8 in the liner and one indicated at 19 in the basin wall, in an operating position of the connector 100 as shown more clearly in FIG. 3B, in which the conduit portion 102 bridges between the liner overflow opening 8 and the basin overflow aperture 19 and extends past the overflow aperture 19, defining the mouth of an overflow passageway collectively defined by the throat 22 and the overflow drainage conduit 24, and into the throat, with the insertion end 105 disposed in or adjacent the throat and thus generally disposed inside the foot spa apparatus. The inner end 104 and the outer insertion end 105 are thus located on opposite sides of the plastic liner body 2. The conduit 102 also covers that portion of the throat 22 having surfaces which are horizontally oriented and along which overflow solution could potentially flow backward, against the normal path of overflow to escape the interior volume of the basin, and thus back into the interior volume where there may be possibility of contamination given that the basin is not sanitized in present-day conventional spa practice (due to implementation of disposable liners). Thus the conduit 102 bridges an unsealed interface between the outer side 7 of the liner and the peripheral wall surface 15A so as to prevent leaking of soaking solution therebetween. It will be appreciated also that in the illustrated arrangement the conduit extends past the interior throat opening 26 and into the overflow drainage conduit 24.

Referring to FIG. 3B, the conduit 102 forms a seal with the liner 1 at the overflow opening 8 therein by mounting of the connector 100 to the liner. In the operating position, the annular contact surface 114 defined by the lip 110 is in contact with the first inner side 6 of the liner which is on an interior side of the liner available to contact the soaking solution. In the illustrated arrangement a water-resistant adhesive 119 (shown schematically) carried on the annular contact surface 114 acts to fasten the connector 100 to the liner 1 such that they become unitary. The adhesion of the lip 110 to the liner 1 provides the seal on the interior side of the liner to prevent the soaking solution from bypassing the conduit 102 and leaking in between liner 1 and basin 10. Also, the overflow opening 8 is sized and shape so that the plastic body 2 of the liner extends past the peripheral rim 113 of the lip 110, which is the transversely outwardmost part of the lip, and meets the outer surface 112 of the conduit 102 around its full circumference which acts to strengthen connection of the connector 100 to the liner 1. As such, in the operating position the lip 110 is spaced from the peripheral wall surface 15A of the soaking basin by the thickness of the liner.

In the illustrated arrangement the lip 110 is integrally formed with the conduit 102 and is made of a material such as plastic or rubber which is readily disposable, so that after use when the soaking solution has been drained through a hole formed in the floor portion 4A of the liner body 2 in alignment and direct communication with the drainage hole 17, the connector 100 which has been in contact with the soaking solution can be discarded along with the liner 1; however, the connector 100 is made of a stiffer material in comparison to the flexible plastic of the liner body 2 so that the connector 100 in the operating position and mounted to the liner body 2 acts to locate the overflow opening in substantial axial alignment with the overflow aperture in the soaking basin and can resist against any shifting of the liner body 2 within the basin 15, for example when soaking solution is being added, as the liner body 2 is simply draped over the top rim 16 and depends down into the bowl of the basin 15 without any direct fastening to same.

Thus, generally speaking, the connector 100 comprises an insertion portion forming the conduit 102 for inserting into the overflow passageway of the soaking basin with the overflow aperture 19 defining the mouth thereof to bridge between same and the overflow opening 8 in the liner. The connector 100 also generally comprises a retention portion forming the lip 110 which protrudes from the outer surface 112 of the conduit so as to provide a mounting surface on the connector 100 for fastening to the liner body 2.

The connector 100 may be sold as a separate component which for example carries adhesive on the contact face of the lip, protected by a removable substrate until the connector is to be mounted to the liner. In an alternative arrangement, there may be no attachment means like the adhesive, as sandwiching of the liner between the lip 110 of the connector and the basin wall 15 with sufficient sustained pressure provided through the friction fit of the connector 100 in the throat maintaining the connector therein at a desired depth alone may be sufficient to provide a seal between the connector and the liner.

Alternatively the disposable liner body 2 and the connector 100 may be sold as a unitary apparatus with the connector 100 already mounted to the liner body 2 such that the conduit 102 is in fluidic communication with the overflow opening 8 at the end of the manufacturing process of the liner, and the insertion end 105 is spaced from the second outer side 7 of the liner body so that the conduit 102 is protruding therefrom.

It will be appreciated that in other embodiments which are not shown, there may be provided more than one connector and corresponding overflow aperture in the soaking basin depending on the rate of overflow drainage to be provided.

In use of an arrangement of the connector which is detached therefrom, the replaceable liner in the form of a thin flexible material is applied or placed over the interior surface of the basin to contain the liquid within the liner and to cover the overflow aperture. That is, in this arrangement the liner is initially wholly imperforate. The liner is punctured for example using the conduit portion 102 of the connector so as to form an opening therein at a location registering with the overflow aperture in the basin, and the conduit is inserted between the opening formed in the liner and the overflow aperture so that the liquid contained by the liner is enabled to drain out of the liner through the conduit and subsequently out of the interior of the basin when the liquid exceeds the prescribed height allowed in the basin, as defined by location of the overflow aperture in the basin. The insertion step is generally consequent to the puncturing step when the liner is disposed in its working position in the liner. The overflow opening in the liner may be formed prior to adding liquid to the basin or after the liquid has been so added. Generally speaking, the basin is filled with the liquid to a height of at least the prescribed height which is the maximum height of the liquid before overflow occurs.

In use of the connector in conjunction with the replaceable liner, additionally to securing the liner in fixed relation to the basing by the inserted connector, the liner may also be secured over the rim of the basin by the attached elastic band 3B.

The scope of the claims should not be limited by the preferred embodiments set forth in the examples but should be given the broadest interpretation consistent with the specification as a whole.

The invention claimed is:

1. A liquid-receiving basin, comprising:

a basin comprising a bottom surface and an upright peripheral wall extending upwardly from the bottom surface to a top rim of the basin, the peripheral wall and the bottom surface collectively defining an interior volume of the basin, the basin having a drain hole in the bottom surface and an overflow aperture extending through the peripheral wall above the bottom surface of the basin at an overflow height; and a disposable liner for placement within the basin, the liner comprising a body of flexible impermeable material forming an amorphous bag, the liner having a floor portion, a peripheral wall portion, and an overflow opening in the peripheral wall portion, the liner is arranged in the basin and covering the peripheral wall of the basin, the bottom surface of the basin, and the drain hole such that the interior of the liner forms a receptacle for containing a liquid and thereby sealing the drain hole from the interior of the liner; and a connector having a first end, a second end and a fluid conduit therebetween, the first end positioned within the interior of the liner, the second end positioned through the overflow opening in the peripheral wall portion of the liner and into the overflow aperture, the fluid conduit providing a fluid path from the interior of the liner to an overflow drainage pathway to enable the liquid to exit the receptacle when the liquid exceeds the overflow height within the basin.

2. The liquid-receiving basin of claim 1, wherein the liner and connector are a unitary assembly with the first end of the connector bonded to the liner around the overflow opening of the liner.

3. The liquid-receiving basin of claim 2, wherein the first end of the connector is bonded to the liner around the overflow opening of the liner using an adhesive.

4. The liquid-receiving basin of claim 2, wherein the first end of the connector comprises a circumferential flange extending radially outward from the fluid conduit, the flange defining an annular contact surface which contacts the interior of the liner around the overflow opening in the liner, and the first end of the connector is bonded to the liner by bonding the annular contact surface to the liner around the overflow opening thereby forming a fluid seal between the connector and the liner around the overflow opening in the liner around the overflow opening.

5. The liquid-receiving basin of claim 4, wherein the annular contact surface is bonded to the liner around the overflow opening using an adhesive.

6. The liquid-receiving basin of claim 1, wherein the basin further comprises the overflow drainage pathway, and the overflow drainage pathway includes an overflow drainage conduit in the basin located externally of the interior volume of the basin for guiding any of the liquid passing through the connector and exiting the receptacle.

7. The liquid-receiving basin of claim 1, wherein a cross-sectional size and shape of the fluid conduit substantially matches a cross-sectional size and shape of the overflow aperture.

8. The liquid-receiving basin of claim 1, wherein a top edge of the liner is secured over the top rim of the basin, and the second end of the connector punctures the liner thereby forming the overflow opening in the liner.

9. The liquid-receiving basin of claim 1, wherein the liner is formed of a thin film such that the liner is so flexible as to collapse on itself without external supporting structure and to conform to a shape of the basin when a liquid is received within the liner.

10. A foot spa apparatus, comprising:

a base arranged for resting on a support surface;

a chair mounted on the base, the chair having a backrest portion and a seat portion; and a foot spa basin mounted on the base and positioned forwardly and below the seat portion of the chair, the foot spa basin comprising:

a basin comprising a bottom surface and an upright peripheral wall extending upwardly from the bottom surface to a top rim of the basin, the peripheral wall and the bottom surface collectively defining an interior volume of the basin, the basin having a drain hole in the bottom surface and an overflow aperture extending through the peripheral wall above the bottom surface of the basin at an overflow height;

a disposable liner comprising a body of flexible impermeable material forming an amorphous bag, the liner having a floor portion and a peripheral wall portion extending upwardly from the floor portion to a height above the overflow aperture, the liner arranged in the basin and covering the peripheral wall and the bottom surface of the basin such that an interior of the liner forms a receptacle for containing the liquid; and a connector having a first end, a second end and a fluid conduit therebetween, the first end positioned within the interior of the liner, the second end positioned through the peripheral wall portion of the liner and into the overflow aperture such that the second end punctures the liner forming an overflow opening in the liner, the fluid conduit providing a fluid path from the interior of the liner to an overflow drainage pathway to enable the liquid to exit the receptacle when the liquid exceeds the overflow height within the basin.

11. The foot spa apparatus of claim 10, wherein the basin further comprises the overflow drainage pathway, and the overflow drainage pathway includes an overflow drainage conduit in the basin located externally of the interior volume of the basin for guiding any of the liquid passing through the connector and exiting the receptacle.

12. The foot spa apparatus of claim 10, wherein a cross-sectional size and shape of the fluid conduit substantially matches a cross-sectional size and shape of the overflow aperture.

13. The foot spa apparatus of claim 10, wherein the first end of the connector comprises a circumferential flange extending radially outward from the fluid conduit, the flange defining an annular contact surface which contacts the interior of the liner around the overflow opening in the liner thereby forming a fluid seal between the connector and the liner around the overflow opening in the liner.

14. The foot spa apparatus of claim 10, wherein the first end of the connector is bonded to the liner around the overflow opening such that the liner and the connector are unitary.

15. The foot spa apparatus of claim 14, wherein the first end of the connector is bonded to the liner around the overflow opening using an adhesive.

16. The foot spa apparatus of claim 10, wherein the first end of the connector comprises a circumferential flange extending radially outward from the fluid conduit, the flange defining an annular contact surface which contacts the interior of the liner around the overflow opening in the liner, and the annular contact surface is bonded to the liner around the overflow opening thereby forming a fluid seal between the connector and the liner around the overflow opening in the liner.

17. The foot spa apparatus of claim 10, wherein the liner arranged in the basin also covers the drain hole such that the liner seals the drain hole from the interior of the liner.

18. The foot spa apparatus of claim 10, wherein the liner is formed of a thin film such that the liner is so flexible as to collapse on itself without external supporting structure and to conform to a shape of the basin when a liquid is received within the liner.

19. A method of using a replaceable liner to contain liquid in a basin, the basin having a drain hole in a bottom of the basin and an overflow aperture in an interior surface of the basin at an overflow height above the bottom of the basin to enable the liquid to drain out of an interior of the basin delimited by said interior surface when the liquid exceeds the overflow height, the method comprising:

inserting a replaceable liner into the basin, the replaceable liner comprising a body of flexible impermeable material forming an amorphous bag, the liner being arranged in the basin such that the liner forms a receptacle for containing liquid which covers the interior surface of the basin at least up to a height of the basin above the overflow height and also covers the drain hole thereby sealing the drain hole from an interior of the receptacle;

puncturing the liner to form an overflow opening in the liner at a location registering with the overflow aperture in the basin; and inserting a connector through the overflow opening in the liner and through the overflow aperture such that a first end of the connector is positioned within the receptacle formed by the liner, a second end of the connector is inserted into the overflow aperture, and a fluid conduit in the connector between the first end and second end forms a fluid pathway which allows liquid contained in the liner to drain out of the liner and out of the basin when the liquid in the liner exceeds the overflow height.

20. The method of claim 19, wherein the liner is punctured using the connector.

21. The method of claim 19, further comprising:

securing an edge of the liner over a top rim of the basin.

22. The method of claim 19, further comprising:

filling the basin with liquid by inserting liquid into the receptacle formed by the liner such that the liner conforms to the shape of the basin.

23. The method of claim 22, further comprising:

puncturing the liner at a location proximate the drain hole to drain the liquid out of the basin liner via the drain hole.

24. The method of claim 23, wherein the basin is filled to a height of at least the overflow height.

25. The method of claim 23, wherein the basin is filled to a height exceeding the overflow height, and liquid drains out of the liner and out of the basin through the connector.

26. The method of claim 19, wherein the basin is a foot spa basin of a foot spa chair, the foot spa chair including a chair mounted on a base and the foot spa basin is mounted on the base in front of the chair.

27. The method of claim 19, wherein the liner is formed of a thin film such that the liner is so flexible as to collapse on itself without external supporting structure and to conform to a shape of the basin when a liquid is received within the liner.

28. A method of using a replaceable liner to contain liquid in a basin, the basin having a drain hole in a bottom of the basin and an overflow aperture in an interior surface of the basin at an overflow height above the bottom of the basin to enable the liquid to drain out of an interior of the basin delimited by said interior surface when the liquid exceeds the overflow height, the method comprising:

inserting a replaceable liner into the basin, the replaceable liner comprising a body of flexible impermeable material forming an amorphous bag configured to conform to a shape of the basin when a liquid is received therein, the liner arranged in the basin such that the liner forms a receptacle for containing liquid which covers the interior surface of the basin at least up to a height of the basin above the overflow height;

inserting a connector through the liner at a location registering with the overflow aperture in the basin, thereby puncturing the liner to form an overflow opening in the liner; and inserting the connector through the overflow aperture such that a first end of the connector is positioned within the receptacle formed by the liner, a second end of the connector is positioned in the overflow aperture, and a fluid conduit in the connector between the first end and second end, the fluid conduit defining a fluid pathway which allows liquid contained in the liner to drain out of the liner and out of the basin when the liquid in the liner exceeds the overflow height.

29. The method of claim 28, further comprising:

securing an edge of the liner over a top rim of the basin.

30. The method of claim 28, further comprising:

filling the basin with liquid by inserting liquid into the receptacle formed by the liner such that the liner conforms to the shape of the basin.

31. The method of claim 30, further comprising:

puncturing the liner at a location proximate the drain hole to drain the liquid out of the basin liner via the drain hole.

32. The method of claim 31, wherein the basin is filled to a height of at least the overflow height.

33. The method of claim 31, wherein the basin is filled to a height exceeding the overflow height, and liquid drains through the connector and out of the liner and basin.

34. The method of claim 28, wherein the basin is a foot spa basin of a foot spa chair, the foot spa chair including a chair mounted on a base and the foot spa basin is mounted on the base in front of the chair.

35. The method of claim 28, wherein the liner is formed of a thin film such that the liner is so flexible as to collapse on itself without external supporting structure and to conform to a shape of the basin when a liquid is received within the liner.

36. The method of claim 28, wherein the liner arranged in the basin also covers the drain hole such that the liner seals the drain hole from the interior of the liner.

37. A liquid-receiving basin, comprising:

a basin comprising a bottom surface and an upright peripheral wall extending upwardly from the bottom surface to a top rim of the basin, the peripheral wall and the bottom surface collectively defining an interior volume of the basin, the basin having an overflow aperture extending through the peripheral wall above the bottom surface of the basin at an overflow height; and a disposable liner for placement within the basin, the liner comprising a body of flexible impermeable material forming an amorphous bag, wherein the liner is formed of a thin film such that the liner is so flexible as to collapse on itself without external supporting structure and to conform to a shape of the basin when a liquid is received within the liner, the liner having a floor portion, a peripheral wall portion, and an overflow opening in the peripheral wall portion, the liner is arranged in the basin and covering the peripheral wall of the basin and the bottom surface of the basin, such that the interior of the liner forms a receptacle for containing a liquid; and a connector having a first end, a second end and a fluid conduit therebetween, the first end positioned within the interior of the liner, the second end positioned through the overflow opening in the peripheral wall portion of the liner and into the overflow aperture, the fluid conduit providing a fluid path from the interior of the liner to an overflow drainage pathway to enable the liquid to exit the receptacle when the liquid exceeds the overflow height within the basin.

38. The liquid-receiving basin of claim 37, wherein the second end of the connector punctures the liner thereby forming the overflow opening in the liner.

* * * * *